US012467184B2

(12) United States Patent
Hartlage et al.

(10) Patent No.: US 12,467,184 B2
(45) Date of Patent: Nov. 11, 2025

(54) LAUNDRY ASSEMBLY AND METHOD FOR CONTROLLING A CONNECTED LAUNDRY APPLIANCE OF THE LAUNDRY ASSEMBLY

(71) Applicant: Haier US Appliance Solutions, Inc., Wilmington, DE (US)

(72) Inventors: Ryan Hartlage, Crestwood, KY (US); Jose Efren Rodriguez Munoz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 378 days.

(21) Appl. No.: 18/318,682

(22) Filed: May 16, 2023

(65) Prior Publication Data

US 2024/0384458 A1 Nov. 21, 2024

(51) Int. Cl.

| | |
|---|---|
| ***D06F 34/05*** | (2020.01) |
| ***D06F 34/28*** | (2020.01) |
| ***D06F 58/38*** | (2020.01) |
| ***D06F 101/20*** | (2020.01) |
| ***D06F 105/50*** | (2020.01) |

(52) U.S. Cl.

CPC ..... *D06F 34/05* (2020.02); *D06F 34/28* (2020.02); *D06F 58/38* (2020.02); *D06F 2101/20* (2020.02); *D06F 2105/50* (2020.02)

(58) Field of Classification Search

CPC ..... D06F 34/05; D06F 34/28; D06F 58/38; D06F 2101/20; D06F 2105/50; D06F 29/005; D06F 58/32

See application file for complete search history.

(56) References Cited

U.S. PATENT DOCUMENTS

| | | | | |
|---|---|---|---|---|
| 7,373,737 | B2 * | 5/2008 | Lyu | D06F 58/38 34/595 |
| 8,567,091 | B2 * | 10/2013 | Jeong | D06F 34/04 34/552 |
| 8,782,222 | B2 * | 7/2014 | Luna | H04L 67/289 709/224 |
| 9,457,625 | B2 * | 10/2016 | Jung | B60C 23/0415 |
| 10,028,201 | B2 | 7/2018 | Fontaine et al. | |
| 10,963,870 | B2 | 3/2021 | Levin | |

(Continued)

FOREIGN PATENT DOCUMENTS

| | | | |
|---|---|---|---|
| JP | 2013132499 | A | 7/2013 |
| JP | 5297934 | B2 | 9/2013 |
| JP | 6603889 | B2 | 11/2019 |

*Primary Examiner* — Ziaul Karim

(74) *Attorney, Agent, or Firm* — Dority & Manning, P.A.

(57) ABSTRACT

A laundry treatment assembly includes a washing machine appliance including a user interface and a dryer appliance, the dryer appliance including a dryer wireless communication module and a dryer controller operably coupled to the dryer wireless communication module, the dryer controller being configured to perform an operation including generating a plurality of request identification codes; emitting a first request identification code; emitting, after an expiration of a predetermined refresh period, a second request identification code; receiving a data package from the washing machine appliance, the data package including a start command to initiate a drying cycle of the dryer appliance and a discrete code of the plurality of request identification codes; and implementing a responsive action in response to receiving the data package.

18 Claims, 6 Drawing Sheets

(56) References Cited

U.S. PATENT DOCUMENTS

| | | | | |
|---|---|---|---|---|
| 11,357,006 | B2 | 6/2022 | Kurian et al. | |
| 2020/0294401 | A1* | 9/2020 | Kerecsen | G08G 1/205 |
| 2021/0157312 | A1* | 5/2021 | Cella | G01M 13/045 |

* cited by examiner

LAUNDRY ASSEMBLY AND METHOD FOR CONTROLLING A CONNECTED LAUNDRY APPLIANCE OF THE LAUNDRY ASSEMBLY

FIELD OF THE INVENTION

The present subject matter relates generally to methods for controlling one appliance using the controls of another appliance communicatively coupled thereto, and more particularly to determining valid identification codes between the connected appliances.

BACKGROUND OF THE INVENTION

Vertically stacked appliance arrangements facilitate efficient use of space. One example of a vertically stacked arrangement includes a dryer appliance stacked on top of a washing machine appliance. As another example, a vertically stacked arrangement may include a washing machine appliance stacked on top of a dryer appliance. Vertically stacked appliances present certain challenges. For instance, the controls of many consumer appliances are located at or near the top of the unit. Accordingly, reaching the controls of the stacked appliance may be difficult for some users, particularly persons of below average height. Indeed, some users must use a stepping tool or other object to reach the controls of the stacked appliance. Thus, controlling a stacked appliance may be inconvenient. In addition to vertically stacked appliance arrangements, some appliance systems or groups are arranged such that the controls of one or more of the appliances are difficult to access or reach. Controlling such difficult-to-access appliances may be inconvenient as well.

When controlling a top appliance of the vertically stacked appliances via the bottom appliance, some start commands may be sent from the bottom appliance to the top appliance through a remote connection. These messages may become delayed for various reasons, including poor connections, sudden power loss, or other potential interference. Thus, in some circumstances, the start commands may be received by the top appliance long after the input was sent from the bottom appliance. This may result in operations or cycles being initiated at inconvenient times within the top appliance.

Accordingly, an appliance system and methods for controlling the same that address one or more of the challenges noted above would be useful. In particular, an appliance system that ensures remote start commands are timely would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment assembly is provided. The laundry treatment assembly may include a washing machine appliance, the washing machine appliance including a user interface; and a dryer appliance. The dryer appliance may include a dryer wireless communication module, and a dryer controller operably coupled to the dryer wireless communication module, wherein the dryer controller is configured to perform an operation. The operation may include generating a plurality of request identification codes; emitting, via the dryer wireless communication module, a first request identification code of the plurality of request identification codes; emitting, after an expiration of a predetermined refresh period, a second request identification code of the plurality of request identification codes; receiving, via the dryer wireless communication module, a data package from the washing machine appliance, the data package including a start command to initiate a drying cycle of the dryer appliance and a discrete code of the plurality of request identification codes; and implementing a responsive action in response to receiving the data package.

In another exemplary aspect of the present disclosure, a method of operating a laundry treatment assembly is provided. The laundry treatment assembly may include a washing machine appliance and a dryer appliance. The method may include generating a plurality of request identification codes within the dryer appliance; emitting, via a dryer wireless communication module, a first request identification code of the plurality of request identification codes; emitting, after an expiration of a predetermined refresh period, a second request identification code of the plurality of request identification codes; receiving, via the dryer wireless communication module, a data package from the washing machine appliance, the data package including a start command to initiate a drying cycle of the dryer appliance and a discrete code of the plurality of request identification codes; and implementing a responsive action in response to receiving the data package.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
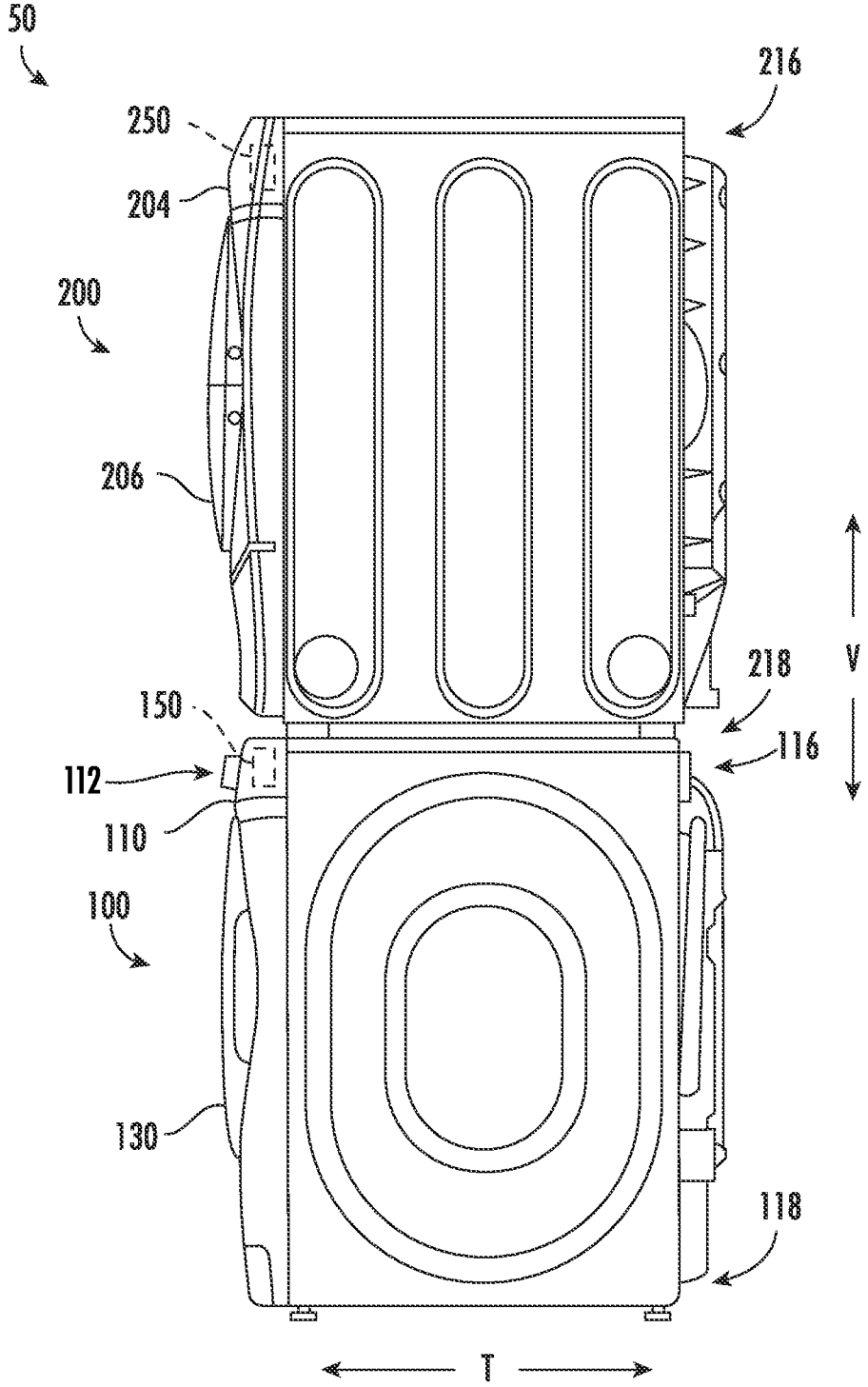
FIG. 1 provides a side view of an appliance system that includes a dryer appliance stacked on a washing machine appliance in accordance with an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
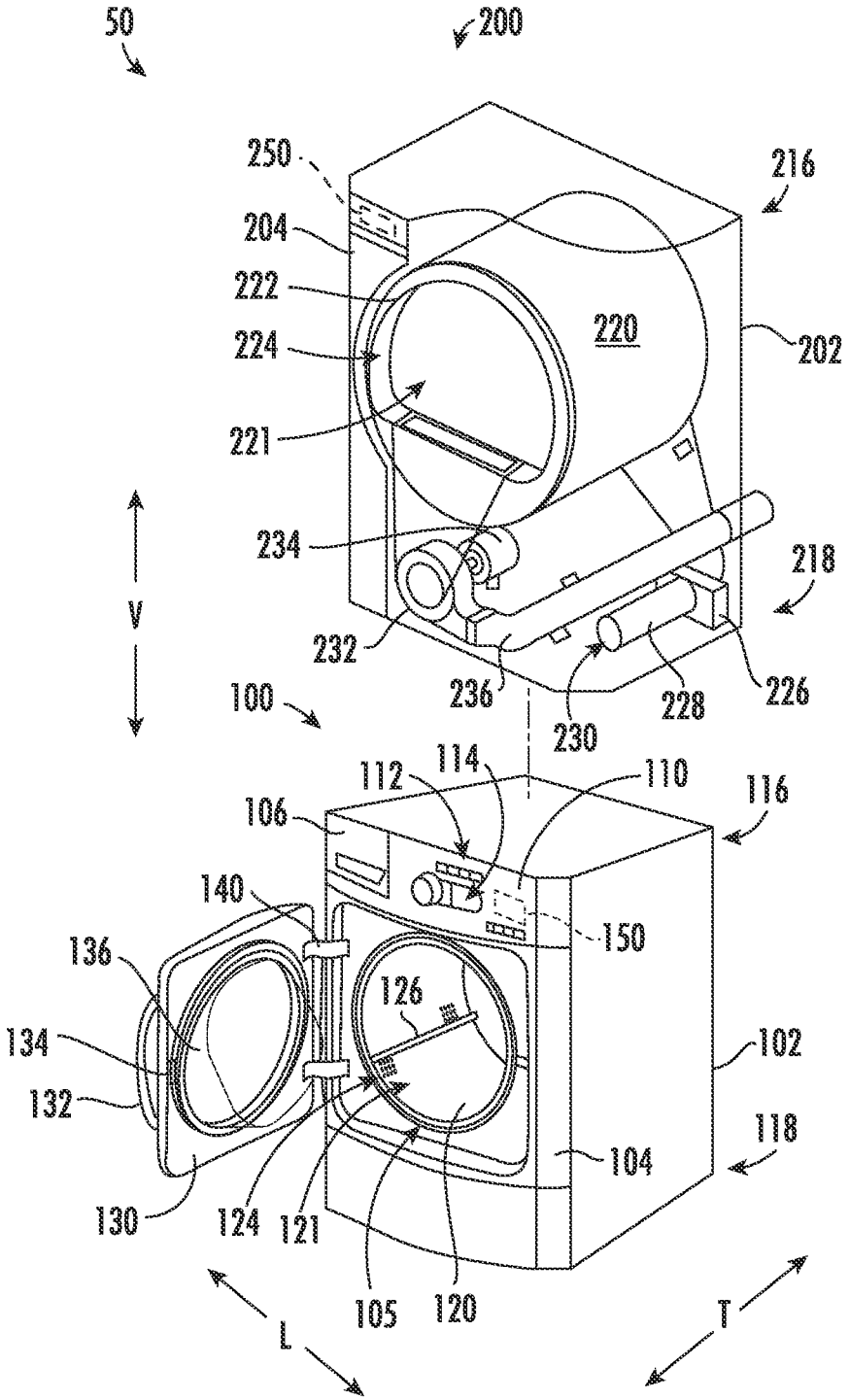
FIG. 2 provides an exploded, perspective view of the appliance system of FIG. 1 depicting a door of the washing machine appliance in an open position and the dryer appliance shown partially cutaway.

FIGS. 1 and 2 provide an exemplary appliance system (or assembly) 50 in accordance with an exemplary embodiment of the present subject matter. In particular, FIG. 1 provides a side elevation view of appliance system 50 and FIG. 2 provides an exploded, perspective view of appliance system 50. As shown, appliance system 50 includes a first appliance and a second appliance. For this embodiment, the first appliance is a washing machine appliance 100 and the second appliance is a dryer appliance 200 stacked thereon. Generally, appliance system 50 defines a vertical direction V, a lateral direction L, and a transverse direction T. The vertical direction V, lateral direction L, and transverse direction T are mutually perpendicular and form an orthogonal direction system.

The exemplary washing machine appliance 100 depicted in FIGS. 1 and 2 is a horizontal axis washing machine appliance. However, while described in the context of a specific embodiment of horizontal axis washing machine appliance 100 arranged in a stacked fashion with dryer appliance 200, using the teachings disclosed herein it will be understood that horizontal axis washing machine appliance 100 is provided by way of example only. Other washing machine appliances having different configurations, different appearances, and/or different features may also be utilized with the present subject matter as well. In addition, the teachings disclosed herein are applicable to other appliances as well, e.g., a dishwasher appliance, microwaves, water heaters, ovens, cooktops, etc.

Washing machine appliance 100 has a cabinet 102 with a drum 120 rotatably mounted therein. Cabinet 102 extends between a top 116 and a bottom 118, e.g., along the vertical direction V. Cabinet 102 also extends between a first side and a second side, e.g., along the lateral direction L, and between a front portion and a rear portion, e.g., along the transverse direction T. A motor (not shown) is in mechanical communication with drum 120 in order to selectively rotate drum 120 (e.g., during an agitation or a rinse cycle of washing machine appliance 100). Drum 120 defines a wash chamber 121 that is configured for receipt of articles for washing. Ribs 126 extend from drum 120 into wash chamber 121. Ribs 126 may assist with agitation of articles disposed within wash chamber 121 during operation of washing machine appliance 100. For example, ribs 126 may lift articles disposed in drum 120 during rotation of drum 120. Drum 120 also defines a plurality of holes 124. Holes 124 are configured to permit a flow of wash fluid between an interior of drum 120 and an exterior of drum 120 (e.g., between drum 120 and a tub of washing machine appliance 100).

Cabinet 102 of washing machine appliance 100 has a front panel 104. A drawer 106 is slidably mounted within front panel 104. Drawer 106 receives detergent and/or other fluid additives (e.g., fabric softener or bleach) and directs the fluid additive to wash chamber 121 during operation of washing machine appliance 100. Front panel 104 defines an opening 105 or loading opening that permits user access to wash chamber 121 of drum 120. A door 130 is rotatably mounted to front panel 104 with a hinge 140. Door 130 permits selective access to wash chamber 121. A window 136 in door 130 permits viewing of wash chamber 121, e.g., during operation of washing machine appliance 100. Door 130 also includes a handle 132 that a user may pull when opening and closing door 130. Latch striker 134 is configured for selectively securing door 130 to a latch (not labeled) when door 130 is in a closed position.

Front panel 104 also includes a user interface panel 110. User interface panel 110 includes a plurality of input selectors 112 and a display 114. Display 114 of user interface panel 110 indicates selected features, a countdown timer, and/or other items of interest to appliance users. In some embodiments, display 114 is a touchscreen, such as e.g., an LCD touchscreen. Input selectors 112 and display 114 collectively provide an interface for users to provide user inputs for operator selection of machine cycles and features. Particularly, in accordance with exemplary aspects of the present disclosure, input selectors 112 and display 114 of user interface panel 110 collectively provide an interface for users to provide user inputs for operator selection of machine cycles and features of washing machine appliance 100 and dryer appliance 200.

Operation of washing machine appliance 100 is controlled by a controller 150 that is communicatively coupled with various components of user interface panel 110. In this way, when a user manipulates input selectors 112 or display 114 to select washing machine cycles and features as well as various cycles and features of dryer appliance 200, controller 150 operates the various components of washing machine appliance 100 and/or dryer appliance 200 to execute selected machine cycles and features.

In some example embodiments, controller 150 may include one or more memory devices and one or more processing devices, such as general or special purpose microprocessors operable to execute programming instructions or micro-control code associated with operating washing machine appliance 100 and/or dryer appliance 200. The memory device (i.e., memory) may represent random access memory, such as e.g., DRAM, or read only memory such as EEPROM or FLASH. In some embodiments, the one or more processing devices execute programming instructions stored in memory. The memory may be a separate component from the processor or may be included onboard within the processor. The memory can store information accessible to processing device, including instructions that can be executed by processing device. Optionally, the instructions can be software or any set of instructions that, when executed by the processing device, cause the one or more processing devices to perform operations. For certain embodiments, the instructions include a software package configured to operate washing machine appliance 100 and/or dryer appliance 200 and interpret one or more electrical signals. For example, the instructions may include a software package configured to execute commands based on feedback from user controls as described more fully below. Controller 150 may be positioned in a variety of locations throughout washing machine appliance 100. As illustrated in FIG. 2, controller 150 is located proximate user interface panel 110 of washing machine appliance 100. In such embodiments, input/output ("I/O") signals may be routed between controller 150 and various operational components of washing machine appliance 100 and/or dryer appliance 200.

Washing machine appliance 100 may be operated in a wash cycle in the following exemplary manner. Laundry items are loaded into wash chamber 121, and washing operation is initiated through operator manipulation of input selectors 112. Drum 120 is filled with water and detergent to form a wash fluid. One or more valves (not shown) can be controlled by washing machine appliance 100 to fill drum 120 to the appropriate level for the amount of articles being washed. Once drum 120 is filled with fluid to the desired level, the laundry items within wash chamber 121 are agitated with rotation of drum 120 and ribs 126 for cleansing the laundry items.

After the agitation phase of the wash cycle is completed, wash fluid is drained from drum 120. Laundry articles can then be rinsed by again adding fluid to drum 120, depending on the cleaning cycle selected by a user, ribs 126 and rotation of drum 120 may again provide agitation within wash chamber 121. One or more spin cycles may also be used. In particular, a spin cycle may be applied after the wash cycle and/or after the rinse cycle in order to wring wash fluid from the articles being washed. During a spin cycle, drum 120 is rotated at relatively high speeds.

The exemplary dryer appliance 200 of appliance system 50 depicted in FIGS. 1 and 2 is a front load or horizontal axis dryer appliance. However, while described in the context of a specific embodiment of horizontal axis dryer appliance 200 arranged in a stacked fashion or manner with washing machine appliance 100, using the teachings disclosed herein it will be understood that horizontal axis dryer appliance 200 is provided by way of example only. Other dryer appliances having different configurations, different appearances, and/or different features may also be utilized with the present subject matter as well.

Dryer appliance 200 has a cabinet 202 and a drum 220 rotatably mounted therein. Particularly, drum 220 is mounted for rotation about a substantially horizontal axis (i.e., an axis that is substantially orthogonal to the vertical direction V). A motor (not shown) is in mechanical communication with drum 220 in order to selectively rotate drum 220 (e.g., during a drying cycle of dryer appliance 200). Drum 220 defines a drying chamber 221 that is configured for receipt of articles for drying. Tumbling ribs may extend from drum 220 into drying chamber 221 for tumbling of laundry articles during a drying cycle. Drum 220 is generally cylindrical in shape, having an imperforate outer cylindrical wall and a front flange or wall 222 defining an opening 224 to drum 220 for loading and unloading of laundry articles.

Cabinet 202 extends between a top 216 and a bottom 218, e.g., along the vertical direction V. Cabinet 202 also extends between a first side and a second side, e.g., along the lateral direction L, and between a front portion and a rear portion, e.g., along the transverse direction T. Cabinet 202 of dryer appliance 200 has a front panel 204. Various drawers may be slidably mounted within front panel 204. A door 206 (FIG. 1) is rotatably mounted to front panel 204, e.g., with a hinge. Door 206 permits selective access to drying chamber 221. A window in door 206 permits viewing of drying chamber 221, e.g., during operation of dryer appliance 200. Door 206 also includes a handle that a user may pull when opening and closing door 206. A latch assembly is configured for selectively securing door 206 in a closed position.

Furthermore, drum 220 includes a rear wall rotatably mounted with cabinet 202 by a suitable bearing. The rear wall of drum 220 defines a plurality of holes or apertures that receive hot air that has been heated by an electric heater 226 in communication with an air supply duct 228 and duct inlet 230. The air is moved from drum 220 by a blower fan 232, which is driven by a blower motor 234. The air may pass through a screen filter configured for trapping lint particles. As the air passes through the screen filter, the air enters a trap duct seal and is passed out of the clothes dryer through an exhaust duct 236. After the clothing articles have been dried, they are removed from drum 220 via opening 224.

Moreover, in some embodiments, front panel 204 also includes a user interface panel. The user interface panel may include a plurality of input selectors and/or a display. The display of the user interface panel of dryer appliance 200 may indicate selected features, a countdown timer, and/or other items of interest to appliance users. In some embodiments, the display is a touchscreen, such as e.g., an LCD touchscreen. The input selectors and display may collectively provide an interface for users to provide user inputs for operator selection of machine cycles and features. For this embodiment, operation of dryer appliance 200 is controlled at least in part by a processing device 250 that is communicatively coupled with controller 150 of washing machine appliance 100. In some exemplary embodiments, in response to user manipulation of user interface panel 110, controller 150 of washing machine appliance 100 generates and communicates a control command that is routed to processing device 160, which in turn causes one or more operational components of dryer appliance 200 to execute selected machine cycles and features. In some embodiments, however, dryer appliance 200 does not include a user interface panel. In yet other embodiments, dryer appliance 200 includes only a processing device 250 without a display or input selectors.

Figure 3:
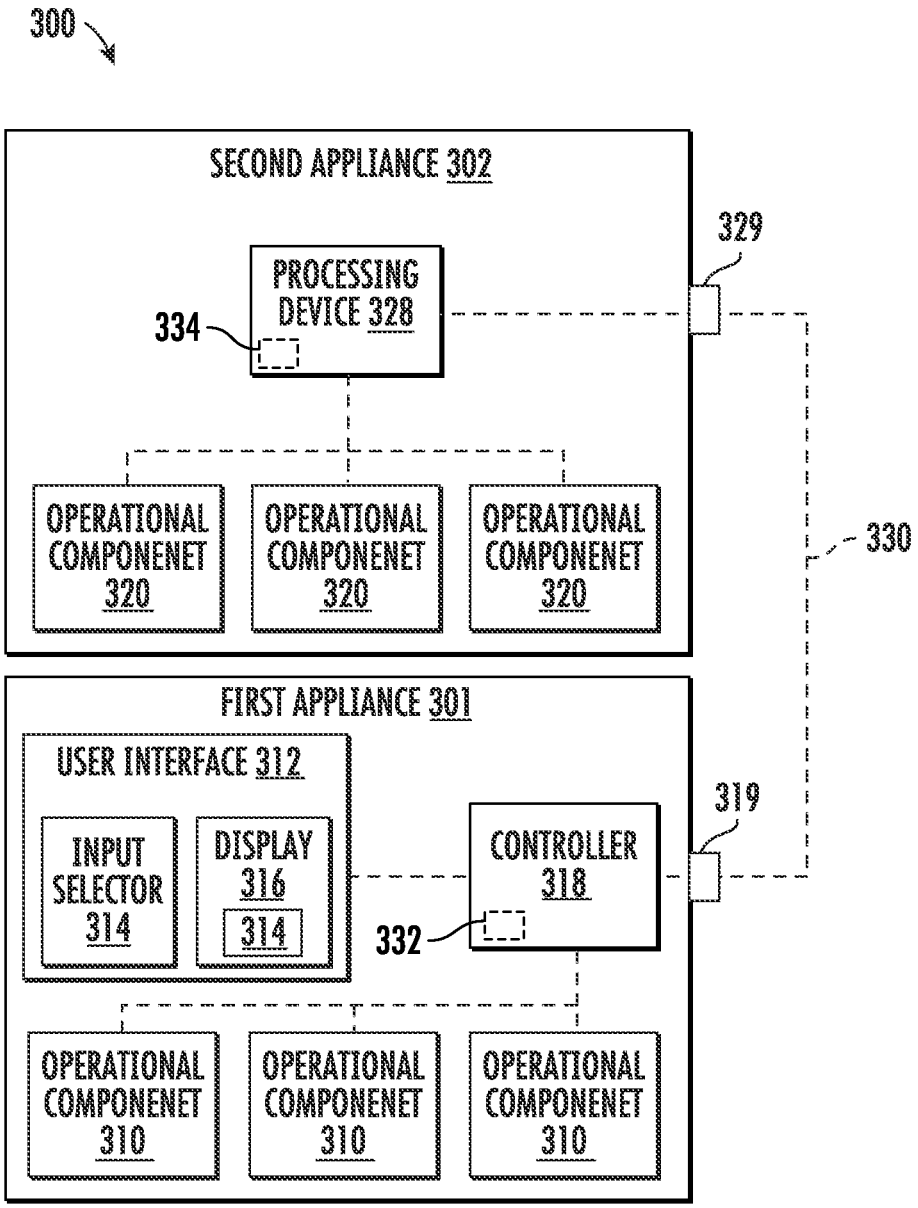
FIG. 3 provides a schematic, block diagram of one exemplary appliance system in accordance with exemplary aspects of the present disclosure.

FIG. 3 provides a schematic, block diagram of one exemplary appliance system 300 in accordance with exemplary aspects of the present disclosure. For this embodiment, appliance system 300 includes a first appliance 301 and a second appliance 302 stacked thereon. For instance, system 300 may be the appliance system 50 of FIGS. 1 and 2 and first appliance 301 and second appliance 302 may be the washing machine appliance 100 and dryer appliance 200 thereof, respectively. In such embodiments, the washing machine appliance defines vertical direction V, and in such embodiments, the dryer appliance is stacked on top of the washing machine appliance along the vertical direction V. e.g., as shown in FIG. 3. In some embodiments, the washing machine appliance defines lateral direction L. In such embodiments, the dryer appliance is positioned adjacent the washing machine appliance along the lateral direction L. That is, the washing machine appliance and dryer appliance may be placed side-by-side. It will be appreciated that system 300 is not limited in scope to the washing machine and dryer appliances of FIGS. 1 and 2. First appliance 301 may be any type of appliance and second appliance 302 may be any type of appliance. For instance, in some embodiments, first appliance 301 is dryer appliance 200 and second appliance 302 is washing machine appliance 100. In some embodiments, first appliance 301 is dryer appliance 200 and second appliance 302 is also dryer appliance 200. In some embodiments, first appliance 301 is an oven appliance and second appliance 302 is a microwave appliance. First and second appliances 301, 302 may be other suitable appliances as well.

Generally, appliance system 300 includes features that allow a user to control second appliance 302 from or using controls of first appliance 301. First appliance 301 includes one or more operational components 310 configured for performing a duty cycle, e.g., a wash cycle. For instance, in embodiments in which first appliance 301 is a washing machine appliance, operational components 310 may include a motor for rotating drum 120 (FIG. 2) about its axis of rotation and/or display 114 (FIG. 2) for displaying relevant duty cycle information to a user. Although three (3) operational components 310 are shown in FIG. 3, first appliance 301 may include any suitable number of operational components 310. First appliance 301 also includes a user interface 312 that includes one or more input selectors 314. In some exemplary embodiments, input selectors 314 may be rotary dials, push buttons, or one or more touchscreen inputs. In some embodiments, user interface 312 of first appliance 301 also includes one or more displays 316. One or all of the displays 316 may be touchscreen displays in which a user may push or touch to control various aspects of first appliance 301, and in some instances, second appliance 302. As further shown in FIG. 3, first appliance 301 includes a controller 318 communicatively coupled with user interface 312 and the operational components 310. First appliance 301 may be communicatively coupled with user interface 312 and operational components 310 in any suitable manner, e.g., by a suitable wireless or wired connection.

Controller 318 may include a memory and processor, such as a general or special purpose microprocessor operable to execute programming instructions or micro-control code associated with a cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 318 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Second appliance 302 includes one or more operational components 320 for performing a duty cycle, e.g., a drying cycle. For instance, in embodiments in which second appliance 302 is a dryer appliance, operational components 320 may include a motor for rotating drum 220 (FIG. 2) about its axis of rotation or for electrically powering electric heater 226, blower fan 232, and/or motor 234 (FIG. 2) to execute or perform the duty cycle of second appliance 302. Although three (3) operational components 320 are shown in FIG. 3, second appliance 302 may include any suitable number of operational components 320. As further shown in FIG. 3, second appliance 302 includes a processing device 328 for controlling the one or more operational components 320 of second appliance 302. Generally, processing device 328 is configured to run a high-level operating system for processing inputs from various control commands, e.g., received from controller 318, and causing the operational components 320 to perform various operations and functions, e.g., to perform a duty cycle. Further, processing device 328 may process various feedback signals from the operational components 320 and one or more sensors of second appliance 302. Such feedback may be routed from processing device 328 to controller 318 of first appliance 301.

Processing device 328 may be communicatively coupled with operational components 320 in any suitable manner, e.g., by a suitable wireless or wired connection. In addition, processing device 328 is communicatively coupled with controller 318 of first appliance 301. In this way, first appliance 301 is communicatively coupled with second appliance 302. First appliance 301 can be communicatively coupled with second appliance 302 in any suitable manner. For instance, first appliance 301 may include a first wireless communication module (e.g., a washer wireless communication module) 332. Optionally, first wireless communication module 332 may be provided within or as a part of controller 318 (e.g., within first appliance 301). First wireless communication module 332 may be configured to emit and/or receive one or more signals (e.g., according to a predetermined pattern). For example, a wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between first appliance 301 and second appliance 302. Additionally or alternatively, first appliance 301 and second appliance 302 may be communicatively coupled via an Ethernet or LAN (Local Area Network) cable 330. Cable 330 may connect a first connection port 319 of first appliance 301 with a second connection port 329 of second appliance 302.

Second appliance 302 may include a second wireless communication module (e.g., a dryer wireless communication module) 334. Optionally, second wireless communication module 334 may be provided within or as a part of processing device 328 (e.g., within second appliance 302). Second wireless communication module 334 may be configured to emit and/or receive one or more signals (e.g., according to a predetermined pattern). For one example, second wireless communication module 334 may periodically emit a wireless beacon or signal (e.g., via a short-range radio). As used herein, "short-range" may include ranges less than about ten meters and up to about one hundred meters. For example, the wireless network may be adapted for short-wavelength (UHF) communications in a band between 2.4 GHz and 2.485 GHz (e.g., according to the IEEE 802.15.1 standard, as described above with reference to first wireless communication module 332). The communication between first and second appliances 301 and 302 (e.g., via first and second wireless communication modules 332 and 334) will be described in further detail below.

Figure 4:
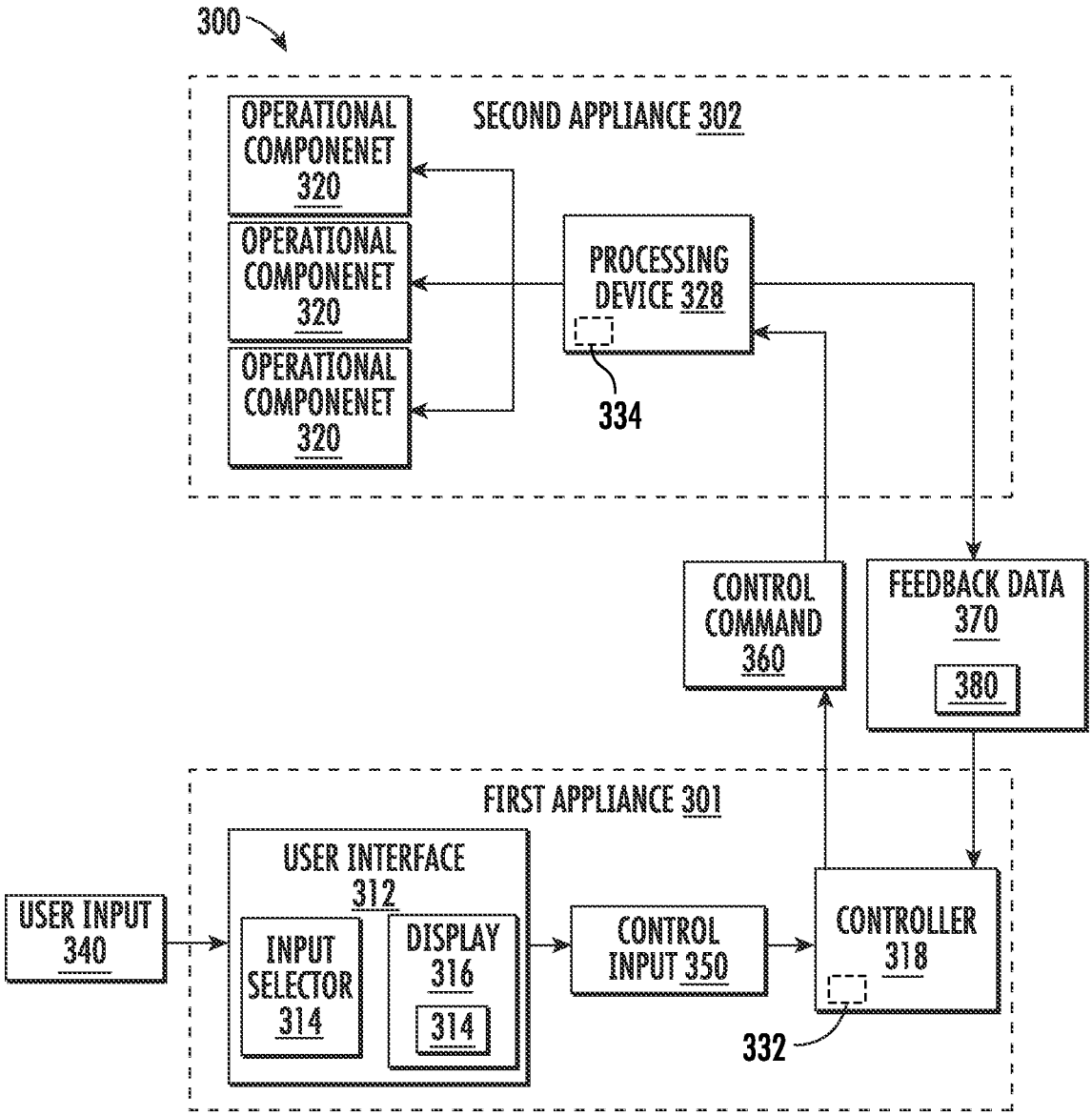
FIG. 4 provides an exemplary flow diagram of an exemplary manner in which a first appliance may be used to control a second appliance in accordance with exemplary aspects of the present disclosure.

FIG. 4 provides an exemplary flow diagram of appliance system 50 depicting an exemplary manner in which first appliance 301 may be used to control second appliance 302. As shown, a user may provide a user input 340 by manipulating one or more input selectors 314 of user interface 312. As one example, input selector 314 may be a rotary dial and a user may turn or rotate the dial to provide user input 340. As another example, input selector 314 may be an icon of display 316 and a user may push or touch the icon to provide user input 340. In some instances, to initiate certain tasks or cycles of first and/or second appliance 301, 302, multiple user inputs 340 may be required. For instance, a user may be required to touch multiple icons of display 316 to initiate a cycle of second appliance 302.

Based at least in part on the user input 340 from the user, a control input 350 is routed to controller 318. As one example, rotation of a rotary dial may generate a signal that is routed to controller 318 as control input 350. As another example, a touch input to an icon of display 316 may generate a signal that is routed to controller 318 as control input 350. Controller 318 of first appliance 301 is configured to receive control input 350 associated with user input 340 to the user interface 312. As noted above, controller 318 may receive multiple control inputs 350. Once the necessary control inputs 350 are received, controller 318 generates a control command 360 based at least in part on the control input 350 or inputs. The control command 360 is representative of instructions for controlling the one or more operational components 320 of the second appliance 302. For example, the control command 360 may be representative of activating a motor and setting the speed output of the motor such that drum 220 (FIG. 2) rotates at a particular rotational speed. The control command 360 may also be representative of setting various outputs of electric heater 226, blower fan 232, and/or motor 234 (FIG. 2) of second appliance 302. Further, in some embodiments, additionally or alternatively, control command 360 is representative of instructions for controlling the one or more operational components 310 of the first appliance 301.

After controller 318 generates the control command 360, controller 318 communicates the control command 360 to second appliance 302 so that the one or more operational components 320 of the second appliance 302 operate the second appliance 302 in a cycle. For the depicted embodiment of FIG. 4, controller 318 (e.g., the washer controller) is configured to communicate the control command 360 to processing device 328 (e.g., the dryer controller). Processing device 328 is configured to receive the control command 360 communicated from the controller 318 of the first appliance 301. Processing device 328 is also configured to activate the one or more operational components 320 of second appliance 302 to operate second appliance 302 in the cycle based at least in part on the control command 360 received from controller 318 of first appliance 301. In some alternative embodiments, controller 318 of first appliance 301 communicates the control command 360 directly to the operational components 320 of second appliance 302. Thus, in such embodiments, controller 318 directly activates the operational components 320 of second appliance 302, e.g., to perform various tasks or to operate second appliance 302 in a cycle, e.g., a drying cycle.

In some exemplary embodiments, controller 318 of first appliance 301 is further configured to determine whether the control input 350 is directed to controlling first appliance 301 or the second appliance 302. In such embodiments, controller 318 generates the control command 360 based at least in part on whether the control input 350 is directed to controlling the first appliance 301 or the second appliance 302. For instance, if the first appliance 301 includes one input selector 314 associated with controlling the first appliance 301 and one input select 314 associated with controlling the second appliance 302, controller 318 determines whether the control input 350 is directed to controlling first appliance 301 or the second appliance 302 based on the input selector manipulated by the user.

Figure 5:
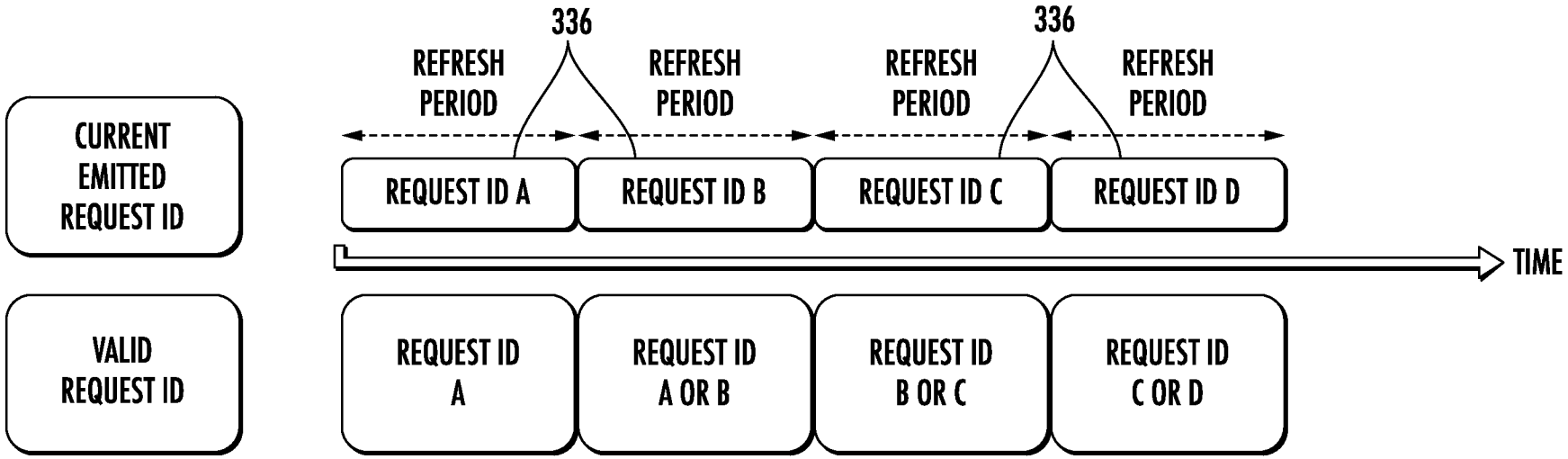
FIG. 5 provides a schematic illustrating a plurality of sequential request identification codes in accordance with exemplary aspects of the present disclosure.

Referring now to FIG. 5, the communication between first appliance 301 and second appliance 302 may include one or more request identification codes 336. In detail, second appliance 302 (e.g., the dryer appliance) may periodically emit or transmit (e.g., via second wireless communication module 334) a request identification code 336. As will be described further below, a plurality of request identification codes 336 may be generated (e.g., within second appliance 302). At periodic intervals (e.g., according to a predetermined refresh period), an individual and unique request identification code 336 may be emitted (e.g., via second wireless communication module 334). For instance, a first request identification code 336 may be generated and emitted. After an expiration of the refresh period, a second request identification code 336 may be emitted. The second request identification code 336 may be different from the first request identification code 336. As would be understood, at the expiration of the refresh period (e.g., after emitting the second request identification code 336), a third request identification code 336 may be emitted. The third request identification code 336 may be different from each of the first and second request identification codes 336. This pattern may be repeated indefinitely (e.g., provided appliance system 300 is powered on). Accordingly, an indefinite number of unique request identification codes 336 may be generated and released (e.g., one at a time) according to a schedule dictated by the refresh period.

First appliance 301 (e.g., washing machine appliance 200) may be configured to receive request identification codes 336. For instance, first wireless communication module (e.g., washer wireless communication module) 332 may receive and recognize the request identification code 336 (e.g., at a predetermined time). First appliance 301 may store the received request identification code 336 (e.g., within a temporary memory). For instance, washer controller 318 may store a most recently received request identification code 336 within the temporary memory until a subsequent request identification code 336 is received. Accordingly, the previously received request identification code 336 may be deleted or otherwise removed from the temporary memory within first appliance 301.

First wireless communication module 332 may be further configured to transmit or emit a data package. In detail, the data package may include one or more commands along with the most recently received request identification code 336. The one or more commands may include a start command to initiate a drying cycle or operation (e.g., within the connected second appliance 302). The start command may be generated at, for instance, user input 340 of first appliance 301 (e.g., the washing machine appliance). Accordingly, the data package is sent from first appliance 301 to second appliance 302 to initiate the operation (e.g., drying cycle) within second appliance 302. In order for the start command to be recognized and validated within second appliance 302, second appliance 302 may determine whether the request identification code 336 provided within the data package is valid. As will be described in further detail below, the valid request identification code 336 may be either one of a most recently emitted request identification code 336, or a request identification code 336 emitted immediately prior to the most recently emitted request identification code 336.

Figure 6:
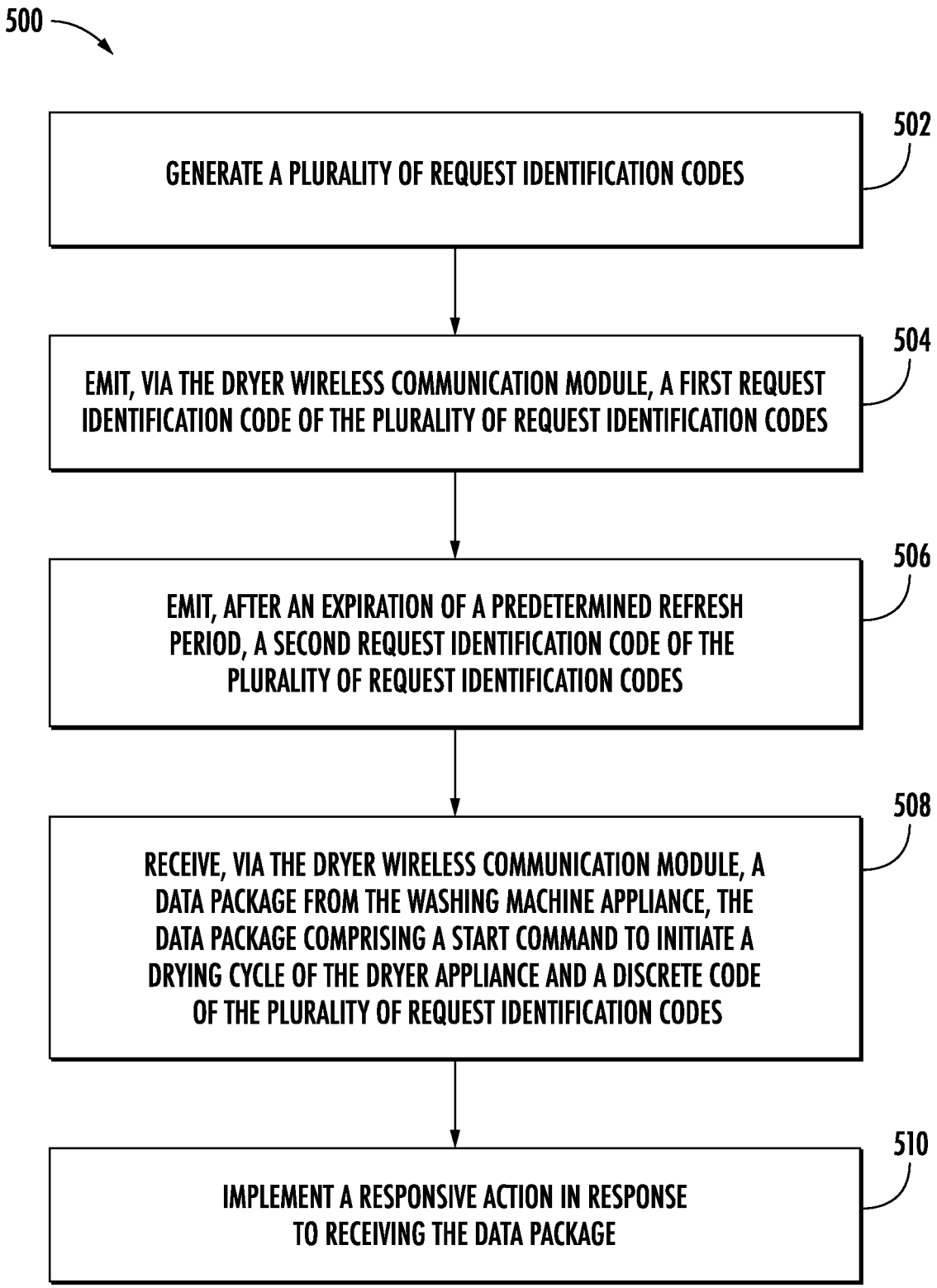
FIG. 6 provides a flow chart of an exemplary method for controlling a second appliance using a first appliance communicatively coupled thereto according to an exemplary embodiment of the present disclosure.

Now that the general descriptions of an exemplary appliance assembly system have been described in detail, a method 500 of operating an appliance system (e.g., appliance system 300) will be described in detail. Although the discussion below refers to the exemplary method 500 of operating appliance system 300, one skilled in the art will appreciate that the exemplary method 500 is applicable to any suitable domestic appliance system or assembly capable of wireless connection (e.g., such as a washing machine/dryer, a refrigerator, a cooking appliance, etc.). In exemplary embodiments, the various method steps as disclosed herein may be performed by controller 318, processing device 328, and/or a separate, dedicated controller. FIG. 6 provides a flow chart illustrating a method of operating an appliance system. Hereinafter, method 500 will be described with specific reference to FIG. 6.

At step 502, method 500 may include generating a plurality of request identification codes. As described above, a connected appliance (e.g., a dryer appliance) from an appliance assembly or system (e.g., a washing machine appliance and the dryer appliance) may generate a plurality of request identification codes. The plurality of request identification codes may be randomly generated by the dryer appliance. For instance, each request identification code may include a predetermined code or character set. In detail, the signal may include or contain a sequence of one or more characters (e.g., once properly deciphered). In some embodiments, the sequence of characters includes a string of numbers, letters, punctuation symbols, or a combination of two or more of such numbers, letters, or punctuation symbols. The string of characters may contain any suitable numbers of characters such that each appliance is uniquely identified by a single signal. Additionally or alternatively, other forms of signals may be incorporated.

Additionally or alternatively, the plurality of request identification codes may be provided in a sequential manner. For instance, a first request identification code may be randomly generated (e.g., as described above). A subsequent (e.g., second) request identification code may then be generated to be sequential to the first request identification code. According to some embodiments, at least one character of the string of characters within the request identification code may be altered in a sequential manner (e.g., from an A to a B, etc.). According to still other embodiments, each of the plurality of request identification codes is generated in real time (e.g., as each request identification code is emitted). Accordingly, the dryer appliance may randomly generate a first request identification code before generating the second request identification code after a predetermined length of time (described below).

At step 504, method 500 may include emitting, via the dryer wireless communication module, a first request identification code of the plurality of request identification codes. As mentioned above, the dryer appliance may include the dryer wireless communication module (e.g., provided within a dryer controller provided within the dryer appliance). The dryer wireless communication module may emit (e.g., through a remote connection, a wired connection, a network connection, etc.) the first generated request identification code. In some embodiments, the first request identification code is emitted to specifically connect with or contact the washing machine appliance.

At step 506, method 500 may include emitting, after an expiration of a predetermined refresh period, a second request identification code of the plurality of request identification codes. Upon emitting the first request identification code, the dryer appliance may wait a predetermined length of time (e.g., the refresh period). As mentioned above, the refresh period may be defined as the length of time between each emittance of one of the plurality of request identification codes. The refresh period may be predetermined (e.g., during manufacture, assembly, initial programming, etc.). In some embodiments, the refresh period is adjustable by a user. In such cases, a maximum limit for the refresh period may be predetermined such that the refresh period is unable to be adjusted to greater than the maximum limit.

As would be understood, after a second expiration of the refresh period, a subsequent (e.g., third) request identification code may be emitted by the dryer appliance. This pattern may continue in such manner provided power is supplied to the dryer appliance. In other words, the pattern may include repeated cyclic intervals. For instance, the cyclic intervals may be between about 15 seconds and about 45 seconds. The dryer appliance (e.g., the dryer wireless communication module) may emit the first request identification code, pause for the refresh period (e.g., between about 15 seconds and about 45 seconds), and emit the second request identification code. This pattern may be repeated indefinitely. Advantageously, a new and unique request identification code is emitted at regular intervals to be received at any opportune time (e.g., by the washer wireless communication module).

At step 508, method 500 may include receiving, via the dryer wireless communication module, a data package from the washing machine appliance. As described above, the data package may include a start command to initiate a drying cycle of the dryer appliance and a discrete code of the plurality of request identification codes. The data package may be emitted by the washing machine appliance (e.g., the other connected appliance of the appliance assembly system). For instance, the start command may be a command to initiate the drying operation within the dryer appliance while being generated within the washing machine appliance.

The start command may be entered (e.g., via a user) at the user interface of the washing machine appliance (e.g., the first appliance). The start command may then be packaged together with the discrete code of the plurality of request identification codes. In detail, the discrete code may be a most recently received request identification code. Thus, the last request identification code received by the washing machine appliance is the discrete code (which may be independent of the time received).

At step 510, method 500 may include implementing a responsive action in response to receiving the data package. In detail, the dryer appliance (e.g., second appliance) may decipher the data package including the start command and the discrete code. In deciphering the discrete code, the dryer appliance may determine whether the discrete code is a valid request identification code. The valid request identification code may be based on the two most recently emitted request identification codes from the dryer appliance. For instance, the discrete code may be deemed to be valid if it is one of a most recently emitted request identification code or a request identification code emitted immediately previous to the most recently emitted request identification code.

As mentioned previously, each of the plurality of request identification codes may be provided in a sequential order. Thus, the dryer appliance may analyze the discrete code to determine when the request identification code was emitted (e.g., as part of the sequence of request identification codes). Additionally or alternatively, the dryer appliance may discern a timeframe at which the discrete code was emitted. For instance, the dryer appliance may consider the predetermined refresh period in analyzing the discrete code. When the discrete code is the request identification code emitted immediately previous to the most recently emitted request identification code, the dryer appliance may determine that the discrete code had been received within a required time frame window (e.g., from the time the request identification code was generated and emitted originally by the dryer appliance).

Upon determining that the discrete code is a valid request identification code, the dryer appliance may execute the start command and initiate the drying cycle. The dryer appliance may thus determine that the data package and subsequently the start command for the drying cycle has been created within a required time frame (e.g., according to the refresh period). Advantageously, the dryer appliance determines that the start command has been recently input (e.g., to the user interface of the connected washing machine appliance) and, and thus the drying cycle can be safely initiated.

Additionally or alternatively, the dryer appliance may determine that the discrete code within the data package is an invalid request identification code. In detail, the dryer appliance may receive and decipher the request identification code included within the data package and compare it against a list of valid request identification codes. As mentioned above, the valid request identification codes may only include a most recently emitted request identification code and a request identification code emitted immediately prior to the most recently emitted request identification code. Therefore, the dryer appliance may determine that the discrete code is neither of the most recently emitted request identification code or the request identification code emitted immediately prior to the most recently emitted request identification code and conclude that the discrete code is an invalid code. The invalid code may be a request identification code emitted at least two prior to the most recently emitted request identification code.

Upon determining that the discrete code is an invalid request identification code, the dryer appliance may ignore the start command to initiate the drying cycle. The dryer appliance may thus determine that the data package is beyond the time limit for initiating the drying cycle due to the invalid request identification code. Accordingly, the drying cycle or operation may not be initiated. Additionally or alternatively, an alert or notification may be emitted (e.g., by the dryer appliance or the washing machine appliance) to a user. In some instances, the alert is provided via a remote device (e.g., via a mobile application). Advantageously, the drying cycle is prohibited from initiating if the request input at the connected washing machine appliance has lapsed a required time limit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment assembly comprising:

a washing machine appliance, the washing machine appliance comprising a user interface; and a dryer appliance, the dryer appliance comprising:

a dryer wireless communication module; and a dryer controller operably coupled to the dryer wireless communication module; wherein the dryer controller is configured to perform an operation, the operation comprising:

generating a plurality of request identification codes;

emitting, via the dryer wireless communication module, a first request identification code of the plurality of request identification codes;

emitting, after an expiration of a predetermined refresh period, a second request identification code of the plurality of request identification codes;

receiving, via the dryer wireless communication module, a data package from the washing machine appliance, the data package comprising a start command to initiate a drying cycle of the dryer appliance and a discrete code of the plurality of request identification codes; and implementing a responsive action in response to receiving the data package.

2. The laundry treatment assembly of claim 1, wherein implementing the responsive action comprises:

determining that the discrete code within the data package is a valid request identification code; and initiating the drying cycle in response to determining that the discrete code within the data package is the valid request identification code.

3. The laundry treatment assembly of claim 2, wherein the plurality of request identification codes is provided in a sequential order.

4. The laundry treatment assembly of claim 3, wherein determining that the discrete code within the data package is the valid request identification code comprises determining that the discrete code is one of a most recently emitted request identification code or a request identification code emitted immediately previous to the most recently emitted request identification code.

5. The laundry treatment assembly of claim 1, wherein implementing the responsive action comprises:

determining that the discrete code within the data package is an invalid request identification code; and ignoring the start command to initiate the drying cycle in response to determining that the discrete code within the data package is the invalid request identification code.

6. The laundry treatment assembly of claim 1, wherein the predetermined refresh period is between 15 second and 45 seconds.

7. The laundry treatment assembly of claim 1, wherein the washing machine appliance further comprises:

a washer wireless communication module; and a washer controller operably coupled to the user interface and the washer wireless communication module.

8. The laundry treatment assembly of claim 7, wherein the washer controller is configured for:

receiving the start command to initiate the dryer cycle via the user interface;

determining a most recently received request identification code of the plurality of request identification codes; and transmitting, via the washer wireless communication module, the data package, the data package including the start command and the most recently received request identification code.

9. The laundry treatment assembly of claim 1, wherein each of the plurality of request identification codes is randomly generated via the dryer controller.

10. A method of operating a laundry treatment assembly, the laundry treatment assembly comprising a washing machine appliance and a dryer appliance; the method comprising:

generating a plurality of request identification codes within the dryer appliance;

emitting, via a dryer wireless communication module, a first request identification code of the plurality of request identification codes;

emitting, after an expiration of a predetermined refresh period, a second request identification code of the plurality of request identification codes;

receiving, via the dryer wireless communication module, a data package from the washing machine appliance, the data package comprising a start command to initiate a drying cycle of the dryer appliance and a discrete code of the plurality of request identification codes; and implementing a responsive action in response to receiving the data package.

11. The method of claim 10, wherein implementing the responsive action comprises:

determining that the discrete code within the data package is a valid request identification code; and initiating the drying cycle in response to determining that the discrete code within the data package is the valid request identification code.

12. The method of claim 11, wherein the plurality of request identification codes is provided in a sequential order.

13. The method of claim 12, wherein determining that the discrete code within the data package is the valid request identification code comprises determining that the discrete code is one of a most recently emitted request identification code or a request identification code emitted immediately previous to the most recently emitted request identification code.

14. The method of claim 10, wherein implementing the responsive action comprises:

determining that the discrete code within the data package is an invalid request identification code; and ignoring the start command to initiate the drying cycle in response to determining that the discrete code within the data package is the invalid request identification code.

15. The method of claim 10, wherein the predetermined refresh period is between 15 second and 45 seconds.

16. The method of claim 10, wherein the washing machine appliance further comprises:

a washer wireless communication module; and a washer controller operably coupled to the washer wireless communication module.

17. The method of claim 16, wherein the washer controller is configured for:

receiving the start command to initiate the dryer cycle via a user interface of the washing machine appliance;

determining a most recently received request identification code of the plurality of request identification codes; and transmitting, via the washer wireless communication module, the data package, the data package including the start command and the most recently received request identification code.

18. The method of claim 10, wherein each of the plurality of request identification codes is randomly generated via the dryer appliance.

* * * * *